US007341944B2

(12) United States Patent
Harutyunyan

(10) Patent No.: US 7,341,944 B2
(45) Date of Patent: Mar. 11, 2008

(54) METHODS FOR SYNTHESIS OF METAL NANOWIRES

(75) Inventor: Avetik Harutyunyan, Columbus, OH (US)

(73) Assignee: Honda Motor Co., Ltd, Minato-Ku, Tokyo (JP)

( * ) Notice: Subject to any disclaimer, the term of this patent is extended or adjusted under 35 U.S.C. 154(b) by 21 days.

(21) Appl. No.: 11/228,784

(22) Filed: Sep. 15, 2005

(65) Prior Publication Data

US 2007/0059928 A1 Mar. 15, 2007

(51) Int. Cl.
*H01L 21/44* (2006.01)

(52) U.S. Cl. ..... 438/679; 438/681; 117/89; 117/104; 427/248.1

(58) Field of Classification Search ..... 439/679, 439/681; 117/89, 104; 427/216, 374, 248.1, 427/249.1

See application file for complete search history.

(56) References Cited

U.S. PATENT DOCUMENTS 5,973,444 A 10/1999 Xu et al.
6,838,720 B2 1/2005 Krieger et al.
2005/0053542 A1* 3/2005 Harutyunyan ..... 423/447.3
2005/0064158 A1* 3/2005 Choi ..... 428/209

FOREIGN PATENT DOCUMENTS

JP 2004-269987 A * 9/2004

OTHER PUBLICATIONS

Harutyunyan, A.R. et al., Self-Assembled Growth of Single-Walled Carbon Nanotubes by Pyrolysis of Metalorganic Precursor, Applied Physics Letters, Jun. 30, 2003, vol. 82, No. 26, pp. 4794-4976.
Ivanov, V. et al. "The Study of Carbon Nanotubules Produced by Catalytic Method", Elsevier Science B.V., Chemical Physics Letters, Jun. 24, 1994, pp. 329-335, vol. 223.
Journet, C. et al., "Large-Scale Production of Single-Walled Carbon Nanotubes by the Electric-Arc Technique", Nature, Aug. 21, 1997, pp. 756-758, vol. 388.
Li, W.Z. et al., "Large-Scale Synthesis of Aligned Carbon Nanotubes", Science, Dec. 6, 1996, pp. 1701-1703, vol. 274.
Thess, A. et al., "Crystalline Robes of Metallic Carbon Nanotubes", Science, Jul. 26, 1996, pp. 483-487, vol. 273.

* cited by examiner

*Primary Examiner*—Hsien-Ming Lee
(74) *Attorney, Agent, or Firm*—Fenwick & West LLP; Mark E. Duell

(57) ABSTRACT

Methods for synthesizing metal nanowires are provided. A metalorganic layer is deposited on a substrate as a thin film. The thermal decomposition of the metalorganic thin film in the presence of air synthesizes metal nanowires. The metal can be varied to produce nanowires with different properties.

31 Claims, 1 Drawing Sheet

Ni nanowires on Si-oxide substrate

Fe nanowires on Si-oxide substrate

Ni nanowires on Si-oxide substrate

Fe nanowires on Si-oxide substrate

METHODS FOR SYNTHESIS OF METAL NANOWIRES

FIELD OF INVENTION

The present invention relates to methods for the preparation of metal nanowires and nanostructures using the metal nanowires.

BACKGROUND

A nanowire refers to a wire having a diameter typically in the range of about one nanometer (nm) to about 500 nm. Nanowires are solid, and can have amorphous structure, graphite like structure, or herringbone structure. The nanowires are periodic only along their axis, and can therefore assume any energetically favorable order in other planes, resulting in a lack of crystalline order.

Nanowires are typically fabricated from a metal or a semiconductor material, and some of the electronic and optical properties of the metal or semiconductor materials are different than the same properties of the same materials in larger sizes. For example, metallic wires having a diameter of 100 nm or less display quantum conduction phenomena, such as the survival of phase information of conduction electrons and the obviousness of the electron wave interference effect. Semiconductor or metal nanowires have attracted considerable attention because of their potential applications in mesoscopic research, the development of nanodevices, for use as gas sensors and field emitters, and the potential application of large surface area structures. For example, U.S. Pat. No. 5,973,444 to Xu et al. discloses carbon fiber-based field emission devices, where carbon fiber emitters are grown and retained on a catalytic metal film as part of the device. Xu et al. disclose that the fibers forming part of the device may be grown in the presence of a magnetic or electric field, as the fields assist in growing straighter fibers.

One technique for fabricating quantum wires utilizes a micro lithographic process followed by metalorganic chemical vapor deposition (MOCVD). This technique may be used to generate a single quantum wire or a row of gallium arsenide (GaAs) quantum wires embedded within a bulk aluminum arsenide (AlAs) substrate. One problem with this technique, however, is that microlithographic processes and MOCVD have been limited to GaAs and related materials. Moreover, this technique does not result in a degree of size uniformity of the wires suitable for practical applications.

Another method of fabricating nanowire systems involves using a porous substrate as a template and filling naturally occurring arrays of nanochannels or pores in the substrate with a material of interest. However, it is difficult to generate relatively long continuous wires having relatively small diameters because as the pore diameters become small, the pores tend to branch and merge, and because of problems associated with filling long pores having small diameters with a desired material.

U.S. Pat. No. 6,838,720 to Krieger et al. discloses a memory device with active passive layers. The ions move from the passive layer to an active layer to form a nanowire feature. The organic layer may be phthalocyanine, but the synthesis of nanowires is not provided.

Harutyunyan et al. Appl. Phys. Lett. 82: 4794-4796 (2003) discloses pyrolysis of a metalorganic precursor for self-assembly of carbon nanotubes. Unlike nanowires, carbon nanotubes are hexagonal networks of carbon atoms forming hollow, seamless tubes with each end capped with half of a fullerene molecule. They were first reported in 1991 by Sumio Iijima who produced multi-layer concentric tubes or multi-walled carbon nanotubes by evaporating carbon in an arc discharge. Presently, there are three main approaches for the synthesis of single- and multi-walled carbon nanotubes. These include the electric arc discharge of graphite rod (Journet et al. Nature 388: 756 (1997)), the laser ablation of carbon (Thess et al. Science 273: 483 (1996)), and the chemical vapor deposition of hydrocarbons (Ivanov et al. Chem. Phys. Lett 223: 329 (1994); Li et al. Science 274: 1701 (1996)). These methods are not suitable for the production of nanowires.

Thus, there is a need for methods for synthesizing metal nanowires, and for the synthesis of metal nanowires at preselected locations on a substrate. Preferably, the method allows for growth of a controlled number of metal nanowires at preselected locations on a substrate.

SUMMARY

The present invention provides methods and processes for the synthesis of metal nanowires and nanostructures. In one aspect, method for synthesizing of nanowires comprises providing a substrate, depositing a metalorganic layer on the substrate, and heating the substrate with the metalorganic layer to form nanowires on the substrate. The substrate can be silicon oxide, aluminum oxide, magnesium oxide, glass, mica, silicon, fiberglass, Teflon, ceramics, plastic, or quartz or mixtures thereof. The metalorganic layer can be metal phthalocyanine, such as iron phthalocyanine or nickel phthalocyanine. The metalorganic can be deposited on the substrate as a thin film, and heated under air to form the metal nanowires.

In another aspect, method for synthesis of nanowires are provided. The method comprises providing a substrate, depositing a metalorganic layer on the substrate, wherein the metalorganic layer is iron phthalocyanine, nickel phthalocyanine or mixtures thereof, and heating the substrate with the metalorganic layer to form nanowires on the substrate.

In another aspect of the invention, method for the synthesis of nanowires comprise providing a substrate, depositing a metalorganic layer on the substrate, wherein the metalorganic layer is iron phthalocyanine, nickel phthalocyanine or mixtures thereof, and wherein the metalorganic layer is deposited by placing a solution of metal phthalocyanine and hydrogen phthalocyanine in a ratio of about 1:20 to about 20:1 on the substrate and heating to form a thin film, and heating the substrate with the thin film to form nanowires on the substrate.

The present invention provides methods and processes for the synthesis of metal nanowires at targeted locations on a substrate. In one aspect, a masking layer is placed on a substrate that leaves selected portions of the substrate exposed. A metalorganic film is then deposited on the substrate. After depositing the precursor film, the masking layer is removed from the substrate. The metalorganic film remaining on the substrate is then pyrolyzed to form metal nanowires. The metalorganic layer can be composed or iron phthalocyanine, nickel phthalocyanine, or combinations thereof

DETAILED DESCRIPTION

I. Definitions

Figure 1A:
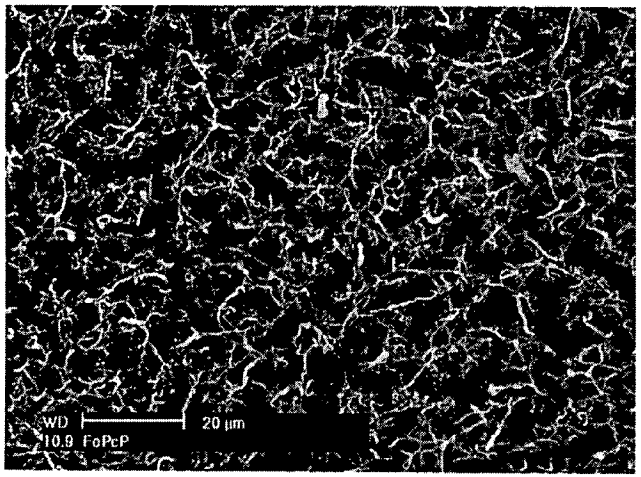
FIG. 1 illustrates the TEM images of the metal nanowires produced by the inventive methods.

Unless otherwise stated, the following terms used in this application, including the specification and claims, have the definitions given below. It must be noted that, as used in the specification and the appended claims, the singular forms "a," "an" and "the" include plural referents unless the context clearly dictates otherwise. Definition of standard chemistry terms may be found in reference works, including Carey and Sundberg (1992) "Advanced Organic Chemistry 3$^{rd}$ Ed." Vols. A and B, Plenum Press, New York, and Cotton et al. (1999) "Advanced Inorganic Chemistry 6$^{th}$ Ed." Wiley, New York.

The terms "metalorganic" or "organometallic" are used interchangeably and refer to co-ordination compounds of organic compounds and a metal, a transition metal or metal halide.

II. Overview

The present invention discloses methods, apparatuses, and processes for the synthesis of metal nanowires and structures composed of metal nanowires.

In one aspect of the invention, a substrate can be provided and a metalorganic layer can be deposited on the substrate. The metal nanowires can be synthesized by thermal decomposition (pyrolysis) of the metalorganic. The properties of the metal nanowires can be selectively varied by choosing the metal in the metalorganic. Typically, metal phthalocyanine can be diluted in hydrogen phthalocyanine (1:10), deposited on the substrate, and heated at 500-600° C. to form a thin film on the substrate. The substrate coated with the film can then be heated to about 550° C. in the presence of air to synthesize the metal nanowires.

In another aspect, a substrate can be provided wherein one of its surfaces has regions covered with a mask and regions that are uncovered or unmasked. A layer of metalorganic compound can be deposited on the unmasked regions, and heated to form a thin layer at particular locations on the substrate. The substrate having thin layer of metalorganic formed on its surface can then be exposed to air and heated to form metal nanowires and nanostructures.

IV. The Substrate

The substrate can be fabricated from a variety of materials, including glasses, plastics, ceramics, metals, gels, membranes, beads, mica, fiberglass, Teflon, quartz, and the like. Preferably, the substrate is composed of a material suitable for use as a support during synthesis of metal nanowires using the methods described below. Such materials include crystalline silicon, polysilicon, silicon nitride, tungsten, magnesium, aluminum and their oxides, preferably silicon oxide, aluminum oxide, and magnesium oxide.

In one aspect of the invention, the substrate can be treated to provide specific location for the growth of the metal nanowires and nanostructures. Such treatment includes masking the surface of the substrate, and having unmasked regions, electrochemical (EC) and photoelectrochemical (PEC) etching to fabricate an individual hole or structure at a specific location on a substrate, and the like. For example, the top surface of the substrate can have portions that are covered with a removable mask and portions that are not covered or are unmasked representing the areas targeted for the synthesis of metal nanowires. The metalorganic is caused to be located in the uncovered areas.

The mask can be composed of any material provided that the material can be removed if desired. The mask can therefore be made of a material that can be relatively easily removed, such as by physical removal, dissolving in water or in a solvent, by chemically or electrochemically etching, or by vaporizing through heating. Thus, the mask materials include water-soluble or solvent-soluble salts such as sodium chloride, silver chloride, potassium nitrate, copper sulfate, and indium chloride, or soluble organic materials such as sugar and glucose. The mask material can also be a chemically etchable metal or alloy such as Cu, Ni, Fe, Co, Mo, V, Al, Zn, In, Ag, Cu—Ni alloy, Ni—Fe alloy and others, or base-dissolvable metals such as Al can also be used. The mask can be made of a soluble polymer such as polyvinyl alcohol, polyvinyl acetate, polyacrylamide, acrylonitrile-butadiene-styrene. The removable mask, alternatively, can be a volatile (evaporable) material such as PMMA polymer. These materials can be dissolved in an acid such as hydrochloric acid, aqua regia, or nitric acid, or can be dissolved away in a base solution such as sodium hydroxide or ammonia. The removable layer or mask may also be a vaporizable material such as Zn which can be decomposed or burned away by heat. The mask can be added by physically placing it on the substrate, by chemical deposition such as electroplating or electroless plating, by physical vapor deposition such as sputtering, evaporation, laser ablation, ion beam deposition, or by chemical vapor decomposition.

Thus, in one aspect, the mask can be an aluminum foil. The aluminum foil can have structures cut or etched onto it. The structures preferably expose areas on the substrate, and denote the location, size, and/or the orientation of the metal nanowires and nanostructures to be synthesized. For example, the structures can be holes at specific locations to give a nanowire at a particular location, V-shaped groves, Y-shaped groves, circles, trenches, and the like, to provide the nanostructures at the locations desired.

III. The Metal and Metalorganic

The metal for use in the invention can be selected from a Group 2A metal, such as Be or Mg, and mixtures thereof, a Group 3A metal, such as Al, and mixtures thereof, a Group 4A metal, such Sn or Pb, and mixtures thereof, a Group V metal, such as V or Nb, and mixtures thereof, a Group VI metal including Cr, W, or Mo, and mixtures thereof, VII metal, such as, Mn, or Re, a Group VIII metal including Co, Ni, Ru, Rh, Pd, Os, Ir, Pt, and mixtures thereof, the lanthanides, such as Ce, Eu, Er, or Yb and mixtures thereof, or transition metals such as Cu, Ag, Au, Zn, Cd, Sc, Y, or La and mixtures thereof. Preferably, the metal is aluminum, iron, cobalt, nickel, titanium, molybdenum, copper, or a mixture thereof.

In one aspect, the metal is complexed to an organic moiety to give a metalorganic compound. Thus, the metals selected from the list above can be complexed with, for example phthalocyanine, porphorin, cyclopentyl, and the like to give the metalorganic compound. Generally, the metalorganic compound is selected such that it has properties such as a high vapor pressure, high purity, high deposition rate, easy handling, non-toxicity, and low cost. A variety of metalorganic precursors can be used to form the metalorganic precursor layer. One suitable metalorganic material is iron phthalocyanine (FePc). FePc is a solid at room temperature, and can be easily purified by sublimation. Heating a FePc sample to a temperature between about 480° C. and about 520° C. generates a suitable amount of FePc vapor for a physical deposition process. Nickel phthalocyanine (NiPc) or a mixture of FePc and MoPc can also be used as the metalorganic precursor. Preferably, any metalorganic compound containing iron or nickel can be used. Examples of such compounds include iron porphyrins.

IV. Synthesis of Metal Nanowires

In one aspect of the invention, the metalorganic compound can be deposited on the substrate as a thin film. The thin film can be deposited by any of the known methods. For example, the metalorganic compound can be deposited on the substrate as a solution and heated to form the thin film. The metalorganic compound can be dissolved in any organic solvent, such as DMSO, DMF, acetone, xylenes, and the like. In one aspect, the metalorganic compound can be metal phthalocyanine, and it can be dissolved in hydrogen phthalocyanine in a ratio of about 20:1 to about 1:20, preferably about 1:1 to about 1:15, more preferably about 1:5 to about 1:15 (w/w). The metal phthalocyanine-hydrogen phthalocyanine solution can be placed on the substrate.

The substrate having the metalorganic compound deposited thereupon can be heated to form a thin film. The heating is preferably below the decomposition temperature of the metalorganic compound. When the metal organic compound is metal phthalocyanine, the heating is preferably to about 500° C. to about 600° C. until a thin film is formed. The heating is preferably for about 10 min. to about 5 h, more preferably about 15 min. to about 60 min., even more preferably about 30 min. to about 45 min. Optionally; the heating can be under a vacuum. A conventional vacuum pump can be connected to the reaction chamber for operating the reaction chamber at reduced pressures in the range of $10^{-5}$ Torr to 760 Torr, preferably in the range of $10^{-4}$ Torr to $10^{-3}$ Torr. The film thus formed typically has a thicknesses of about 1 micron to about 100 microns, preferably a thickness of about 1 micron to about 30 microns, even more preferably a thickness of about 1 micron to about 10 microns, or any thickness in between.

In another aspect, the process of the invention is carried out by vaporizing one or more organometallic compounds, transporting, using a carrier gas, the vaporized precursor(s) to the surface of the substrate and forming a thin film on the surface of the substrate through a chemical reaction. The physical vapor deposition described above can be advantageous in that it can be carried out at a relatively low temperature, the constitution and deposition rate of the thin film can be readily controlled by changing the amounts of the source materials and the carrier gas, and the final thin film displays good uniformity without causing any damage on the surface of the substrate.

In another aspect of the invention, the substrate can have portions that are covered with a removable mask. During the physical vapor deposition process, a layer of the metalorganic precursor will form on all exposed surfaces of the substrate. Thus, a metalorganic layer will be formed on top of the mask as well as the exposed portions of the substrate. Typical thicknesses for the metalorganic layer range from about 1 micron to about 30 microns. However, physical vapor deposition can be used to create metalorganic layers of up to 50 microns or greater if such layers are desired.

After depositing the metalorganic precursor layer, the mask is removed from the substrate. The method of removing the mask depends on the type of masking layer used. For example, if the mask is composed of a layer of aluminum foil or thin plastic, the mask can be lifted off of the underlying substrate. In such an example, the physical removal of the mask also removes the portions of the metalorganic layer deposited on the mask. Thus, the metalorganic layer will remain only in the deposition targets.

The thin film of the organometallic on the surface of the substrate can be oxidized or pyrolyzed. Oxidizing or pyrolysing the metalorganic layer causes oxidation of the organic components of the metalorganic compound. One method for the pyrolysing the thin metalorganic film is to heat the substrate to a temperature between about 450° C. and about 650° C. in the presence of air. For example, the substrate with a thin film of the metalorganic can be placed in a reaction chamber, gas inlet can be attached to a source air, temperature of the oven can then be raised to 550° C. while flowing air. These processing conditions can be maintained for between 2 to 4 hours in order to pyrolyze the organic components in the metalorganic layer, leaving metal nanowires on the substrate.

The size and type of the metal nanowires and nanostructures formed using the present process depends in part on the thickness of the metalorganic film deposited. Without being bound by any particular theory, it is believed that formation of thicker metalorganic films on the substrate leads to the synthesis of larger diameter metal nanowires and nanostructures. For example, pyrolysis of a 1 micron layer of FePc will result in formation of metal nanowires that are about 10 microns long and about 1 nm in diameter. Under similar conditions, pyrolysis of a 5-10 micron layers of FePc produces metal nanowires with a diameter of 35 nm.

The metal nanowires and nanostructures produced by the methods and processes described above can be used in applications that include Field Emission Devices, Memory devices (high-density memory arrays, memory logic switching arrays), Nano-MEMs, AFM imaging probes, distributed diagnostics sensors, and strain sensors. Other key applications include: thermal control materials, super strength and light weight reinforcement and nanocomposites, EMI shielding materials, catalytic support, gas storage materials, high surface area electrodes, and light weight conductor cable and wires, and the like.

EXAMPLES

Below are examples of specific embodiments for carrying out the present invention. The examples are offered for illustrative purposes only, and are not intended to limit the scope of the present invention in any way. Efforts have been made to ensure accuracy with respect to numbers used (e.g., amounts, temperatures, etc.), but some experimental error and deviation should, of course, be allowed for.

Example 1

Purification of the Metalorganic Sample

It may be desirable to purify the metalorganic precursor prior to deposition on the substrate. For example, FePc samples often contain up to 20% by weight of other materials. The contamination can affect the properties of the thin film which may affect the repeatability and reliability of the synthesis method. In order to reduce the impact of such contamination, the metalorganic precursor sample can be purified prior to use, such as by recrystallization or by the process of physical vapor deposition. During purification, a metalorganic sample to be purified is placed in a reactor along with a deposition target for collecting purified metalorganic material. The sample of FePc is heated to a temperature between about 480° C. and about 520° C., while the temperature for collection is set to between about 200° C. and about 300° C. The physical vapor deposition process for purification is carried out at a pressure of $10^{-4}$ Torr. The vacuum pump not only maintains the pressure within the reaction chamber, but also creates a flow within reaction chamber toward the deposition target. The process conditions are maintained for roughly 10 hours, or until all of the initial sample to be purified has undergone sublimation. If desired, a metalorganic sample can be purified multiple times to achieve still higher crystallinity and purity.

Example 2

Synthesis of Metal Nanowires

Figure 1B:
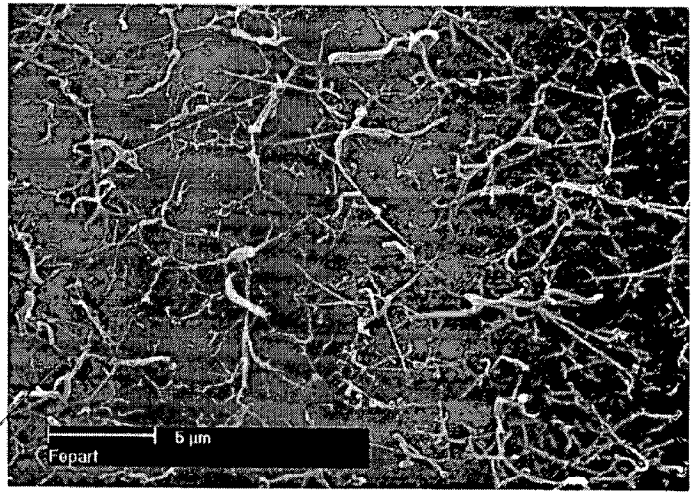
Figure 1C:
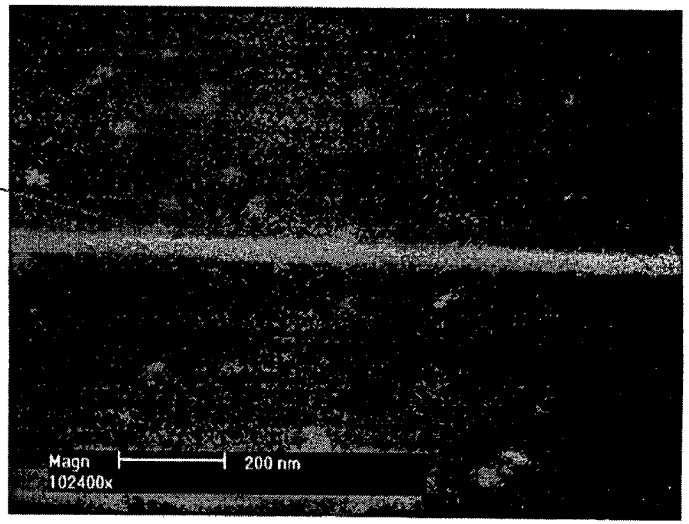

A silicon oxide rectangle having length, width, and depth of 4 cm, 4 cm, and 0.5 cm, respectively, was selected as the substrate. A solution of iron phthalocyanine ($FeC_{32}H_{16}N_8$) in hydrogen phthalocyanine (1:10 w/w) was deposited on the top surface of the substrate. The substrate was then placed in the reaction chamber of an oven. The pressure in reaction chamber was reduced to approximately $10^{-4}$ Torr by vacuum pump, and the temperature in the reaction chamber was increased to between about 500° C. and about 600° C. These temperatures were maintained for about 30 min. until a thin film of metalorganic having a thickness of about 2 microns formed on the substrate. The substrate with the thin film can now be removed. Alternatively, the furnace can be attached to a source of air. The temperature of the oven was then adjusted to about 550° C. while flowing 1000 standard cubic centimeters per minute of air. These processing conditions were maintained for between 2 to 4 hours in order to pyrolyze the organic components in the metalorganic layer, leaving behind metal nanowires on the substrate. The substrate with the metal nanowires thus obtained can be removed from the reaction chamber. FIG. 1 shows the TEM images of metal nanowires thus produced. FIG. 1A shows the nickel nanowires supported on silicon oxide, while FIGS. 2B and 2C show the iron nanowires supported on silicon oxide at low and high magnification, respectively.

While the invention has been particularly shown and described with reference to a preferred embodiment and various alternate embodiments, it will be understood by persons skilled in the relevant art that various changes in form and details can be made therein without departing from the spirit and scope of the invention. All printed patents and publications referred to in this application are hereby incorporated herein in their entirety by this reference.

I claim:

1. A method for synthesizing metal nanowires, the method comprising:

providing a substrate;

depositing a metalorganic layer on the substrate wherein the metalorganic layer is metal phthalocyanine; and heating the substrate with the metalorganic layer to form the nanowires on the substrate.

2. The method of claim 1, wherein the substrate is selected from the group consisting of silicon oxide, aluminum oxide, magnesium oxide, glass, mica, silicon, fiberglass, teflon, ceramics, plastic, and quartz or mixtures thereof.

3. The method of claim 2, wherein the substrate is silicon oxide.

4. The method of claim 1, wherein the metal is selected from the group consisting of a Group V metal, a Group VI metal, a Group VII metal, a Group VIII metal, a lanthanide, and a transition metal, or mixtures thereof.

5. The method of claim 4, wherein the metal is selected from the group consisting of Fe, V, Nb, Cr, W, Mo, Mn, Re, Co, Ni, Ru, Rh, Pd, Os, Ir, Pt, Ce, Eu, Er, Yb, Ag, Au, Zn, Cd, Sc, Y, or La or mixtures thereof.

6. The method of claim 5, wherein the metal is Fe.

7. The method of claim 5, wherein the metal is Ni.

8. The method of claim 1, wherein the metalorganic layer is deposited by placing a solution of metal phthalocyanine on the substrate and heating to form a thin film.

9. The method of claim 8, wherein the solution comprises metal phthalocyanine and hydrogen phthalocyanine in a ratio of about 1:20 to about 20:1.

10. The method of claim 8, wherein the heating is to a temperature of about 500° C. to about 600° C.

11. The method of claim 10, further comprising a vacuum.

12. The method of claim 1, wherein the metalorganic layer has a thickness of between about 1 micron and about 30 microns.

13. The method of claim 1, wherein heating the metalorganic layer deposited on the substrate comprises exposing the metalorganic layer to air at a temperature of between about 450° C. and about 500° C.

14. The method of claim 13, further comprising another gas.

15. The method of claim 14, wherein the other gas is selected from the group consisting of hydrogen, helium, argon, neon, krypton and xenon or a mixture thereof.

16. A method for synthesizing metal nanowires, the method comprising:

providing a substrate;

depositing a metalorganic layer on the substrate, wherein the metalorganic layer is iron phthalocyanine, nickel phthalocyanine or mixtures thereof; and heating the substrate with the metalorganic layer to form the nanowires on the substrate.

17. The method of claim 16, wherein the substrate is selected from the group consisting of silicon oxide, aluminum oxide, and magnesium oxide, glass, mica, silicon, fiberglass, teflon, ceramics, plastic, and quartz or mixtures thereof.

18. The method of claim 17, wherein the substrate is silicon oxide.

19. The method of claim 16, wherein the metalorganic layer is deposited by placing a solution of metal phthalocyanine on the substrate and heating to form a thin film.

20. The method of claim 19, wherein the solution comprises metal phthalocyanine and hydrogen phthalocyanine in a ratio of about 1:20 to about 20:1.

21. The method of claim 19, wherein the heating is to a temperature of about 500° C. to about 600° C. under a vacuum.

22. The method of claim 16, wherein the metalorganic layer has a thickness of between about 1 micron and about 30 microns.

23. The method of claim 16, wherein heating the metalorganic layer deposited on the substrate comprises exposing the metalorganic layer to air at a temperature of between about 450° C. and about 500° C.

24. The method of claim 23, further comprising another gas selected from the group consisting of hydrogen, helium, argon, neon, krypton and xenon or a mixture thereof.

25. A method for synthesizing metal nanowires, the method comprising:

providing a substrate;

depositing a metalorganic layer on the substrate, wherein the metalorganic layer is iron phthalocyanine, nickel phthalocyanine or mixtures thereof, and wherein the metalorganic layer is deposited by placing a solution of metal phthalocyanine and hydrogen phthalocyanine in a ratio of about 1:20 to about 20:1 on the substrate and heating to form a thin film; and heating the substrate with the thin film to form the nanowires on the substrate.

26. The method of claim 25, wherein the substrate is selected from the group consisting of silicon oxide, aluminum oxide, and magnesium oxide, glass, mica, silicon, fiberglass, teflon, ceramics, plastic, and quartz or mixtures thereof.

27. The method of claim 26, wherein the substrate is silicon oxide.

28. The method of claim 25, wherein the heating is to a temperature of about 500° C. to about 600° C. under a vacuum.

29. The method of claim 25, wherein the thin film has a thickness of between about 1 micron and about 30 microns.

30. The method of claim 25, wherein heating the thin film deposited on the substrate comprises exposing the metalorganic layer to air at a temperature of between about 450° C. and about 500° C.

31. The method of claim 30, further comprising another gas selected from the group consisting of hydrogen, helium, argon, neon, krypton and xenon or a mixture thereof.

* * * * *